US011684157B1

(12) United States Patent
Stravitz

(10) Patent No.: US 11,684,157 B1
(45) Date of Patent: Jun. 27, 2023

(54) FURNITURE WITH ANTI-TIPPING SUPPORT HINGE

(71) Applicant: Thoughtful Furniture Company, LLC, New York, NY (US)

(72) Inventor: David M. Stravitz, New York, NY (US)

(73) Assignee: Thoughtful Furniture Company, LLC, New York, NY (US)

( * ) Notice: Subject to any disclaimer, the term of this patent is extended or adjusted under 35 U.S.C. 154(b) by 0 days.

(21) Appl. No.: 18/065,548

(22) Filed: Dec. 13, 2022

(51) Int. Cl.
*A47B 88/50* (2017.01)
*A47B 97/00* (2006.01)
*A47B 88/919* (2017.01)

(52) U.S. Cl.
CPC ..... *A47B 88/50* (2017.01); *A47B 88/919* (2017.01); *A47B 97/00* (2013.01); *A47B 2097/008* (2013.01)

(58) Field of Classification Search
CPC ..... A47B 88/50; A47B 88/919; A47B 97/00; A47B 2097/008
See application file for complete search history.

(56) References Cited

U.S. PATENT DOCUMENTS

| | | | |
|---|---|---|---|
| D22,730 | S | 8/1893 | Shoudy |
| D46,792 | S | 12/1914 | Purcell |
| 1,233,775 | A | 7/1917 | Hagar |
| 1,376,203 | A | 4/1921 | Payne |
| 1,730,391 | A | 10/1929 | Stobba |
| 2,104,214 | A | 1/1938 | Vezina |
| D182,833 | S | 5/1958 | Lubbert et al. |
| D215,731 | S | 10/1969 | Solie |
| 4,120,549 | A | 10/1978 | Bureau |
| D251,885 | S | 5/1979 | Tebbe et al. |
| 4,214,323 | A | 7/1980 | Thomas |
| D272,398 | S | 1/1984 | West |

(Continued)

FOREIGN PATENT DOCUMENTS

| | | | | |
|---|---|---|---|---|
| CN | 112120427 A | * | 12/2020 | ..... A47B 67/04 |
| FR | 2620303 A1 | | 3/1989 | |

(Continued)

OTHER PUBLICATIONS

English translation of KR200495380 Y1 (Year: 2023).*

(Continued)

*Primary Examiner* — Daniel J Rohrhoff
(74) *Attorney, Agent, or Firm* — Brian Roffe

(57) ABSTRACT

Support hinge for a piece of furniture includes a mounting plate attachable to an underside of a bottom drawer of the piece of furniture, and a support plate hingedly connected to the mounting plate to enable the support plate to open rearward to an angle of greater than 90 degrees relative to the mounting plate. The support plate is biased into the open state and includes a drawer support portion that preferably contacts the underside of the bottom drawer when the support plate is in the open state. When the bottom drawer is open, the support plate is just above the floor below the piece of furniture and when a weight-derived force is exerted against the bottom drawer, the support plate is moved against the floor and in such a position, acts as a post to prevent forward tipping of the furniture beyond a nominal amount.

20 Claims, 4 Drawing Sheets

(56) References Cited

U.S. PATENT DOCUMENTS

| | | | | |
|---|---|---|---|---|
| D272,497 | S | 2/1984 | Kemp, III et al. | |
| 4,607,972 | A * | 8/1986 | Hennick | F16B 12/20 403/231 |
| 4,669,695 | A | 6/1987 | Chou | |
| D305,485 | S | 1/1990 | Zalesak | |
| 4,890,813 | A | 1/1990 | Johnson et al. | |
| 5,013,103 | A | 5/1991 | Addison | |
| 5,076,525 | A | 12/1991 | Whipple | |
| 5,174,543 | A | 12/1992 | Corson et al. | |
| D333,578 | S | 3/1993 | White | |
| 5,192,123 | A | 3/1993 | Wallin | |
| D339,938 | S | 10/1993 | Fisher | |
| D347,337 | S | 5/1994 | Keller | |
| 5,352,031 | A | 10/1994 | Nahrgang | |
| 5,431,365 | A | 7/1995 | Hopkins | |
| 5,599,000 | A | 2/1997 | Bennett | |
| D384,525 | S | 10/1997 | McBrayer et al. | |
| 5,794,903 | A | 8/1998 | Peterson, II | |
| D424,833 | S | 5/2000 | Zaidman | |
| 6,068,355 | A | 5/2000 | Thorp | |
| 6,220,562 | B1 | 4/2001 | Konkle | |
| D467,096 | S | 12/2002 | DiCostanzo | |
| 6,508,525 | B2 | 1/2003 | Picogna | |
| 6,533,238 | B2 | 3/2003 | Barnes et al. | |
| D473,401 | S | 4/2003 | de Blois | |
| D503,564 | S | 4/2005 | Juneau et al. | |
| D508,347 | S | 8/2005 | Juneau et al. | |
| D512,903 | S | 12/2005 | Gallien | |
| D514,846 | S | 2/2006 | McDiarmid | |
| D518,975 | S | 4/2006 | Mohundro | |
| 7,185,872 | B2 | 3/2007 | Lowenstein, Jr. | |
| D542,057 | S | 5/2007 | Juneau | |
| 7,287,820 | B2 | 10/2007 | Van Loon et al. | |
| D555,394 | S | 11/2007 | Sexton | |
| D586,147 | S | 2/2009 | Tsay et al. | |
| D599,136 | S | 9/2009 | Jeup | |
| D605,742 | S | 12/2009 | Bock et al. | |
| D606,180 | S | 12/2009 | Bock et al. | |
| D606,634 | S | 12/2009 | Bock et al. | |
| D606,635 | S | 12/2009 | Bock et al. | |
| D611,267 | S | 3/2010 | Collette | |
| D617,117 | S | 6/2010 | Tovin | |
| 7,775,498 | B2 | 8/2010 | Phillips et al. | |
| D625,305 | S | 10/2010 | Bleck et al. | |
| 9,163,842 | B2 | 10/2015 | Adams et al. | |
| 9,578,965 | B2 | 2/2017 | Hamaba et al. | |
| D790,888 | S | 7/2017 | Everson et al. | |
| 9,861,194 | B1 * | 1/2018 | Park | A47B 67/04 |
| 9,955,785 | B2 | 5/2018 | Kato | |
| 10,113,687 | B2 | 10/2018 | Wise | |
| 10,321,762 | B2 | 6/2019 | Muskopf | |
| 10,362,873 | B1 * | 7/2019 | Farnsworth | F16B 1/00 |
| D862,135 | S | 10/2019 | Birch | |
| D867,791 | S | 11/2019 | Birch | |
| 10,524,572 | B2 | 1/2020 | Lercher | |
| 10,758,046 | B1 | 9/2020 | Stravitz et al. | |
| 10,786,080 | B1 | 9/2020 | Stravitz et al. | |
| 10,812,456 | B2 | 10/2020 | Pollet et al. | |
| 10,813,456 | B1 | 10/2020 | Stravitz et al. | |
| 10,939,761 | B1 | 3/2021 | Stravitz et al. | |
| 11,103,067 | B2 * | 8/2021 | Stravitz | A47B 91/12 |
| 11,375,814 | B1 * | 7/2022 | Stravitz | F16M 13/02 |
| 2003/0010886 | A1 | 1/2003 | Barnes et al. | |
| 2003/0221593 | A1 | 12/2003 | Usagani | |
| 2006/0207989 | A1 | 9/2006 | Ritchie et al. | |
| 2006/0265806 | A1 | 11/2006 | Stevenson | |
| 2007/0039640 | A1 | 2/2007 | Zheng | |
| 2011/0043088 | A1 | 2/2011 | McConnell et al. | |
| 2013/0087675 | A1 | 4/2013 | Miller | |
| 2014/0263925 | A1 | 9/2014 | Essrig | |
| 2015/0130339 | A1 | 5/2015 | Barnett | |
| 2015/0130342 | A1 | 5/2015 | Barnett | |
| 2017/0021958 | A1 | 1/2017 | Shelton | |
| 2018/0168344 | A1 | 6/2018 | Arrillaga Albeniz | |
| 2018/0209580 | A1 | 7/2018 | Wise | |
| 2019/0150617 | A1 | 5/2019 | Lager et al. | |
| 2019/0365098 | A1 | 12/2019 | Johannesson | |

FOREIGN PATENT DOCUMENTS

| | | | |
|---|---|---|---|
| FR | 2979210 | A1 | 3/2013 |
| JP | 3014942 | U | 8/1995 |
| KR | 200484018 | Y1 | 7/2017 |
| KR | 10194900 | B1 | 2/2018 |
| KR | 200495380 | Y1 * | 12/2021 |
| RU | 2315537 | C2 | 1/2008 |
| WO | 0024293 | A1 | 5/2000 |

OTHER PUBLICATIONS

No, Dressers Don't Need To Be Anchored To A Wall, by John Brownlee, Jul. 13, 206, downloaded Jan. 26, 2020.
DE20116637 Zerver; Abstract and figure (2001).
CN209474157 Chang et al.; Abstract and figure (2019).
English translation FR 2620303, 1989.
International Search Report for PCT/US2020/063547 dated Mar. 25, 2021.
Written Opinion for PCT/US2020/063547 dated Mar. 25, 2021.
Gerridan Chest of Drawers from ashleyfurniture.com, retrieved date Jun. 10, 2021, p. 1 from www.ashleyfurniture.com/p/gerridan_chest_of_drawers/B1190-44.html (Year: 2021).

* cited by examiner

FURNITURE WITH ANTI-TIPPING SUPPORT HINGE

FIELD OF THE INVENTION

The present invention relates generally to anti-tipping mechanisms for furniture that prevent the furniture from tipping over when, for example, a child is climbing into or present in an open drawer of the furniture. The present invention also relates to a piece of furniture including or incorporating an anti-tipping mechanism, and a method for forming a piece of furniture to provide anti-tipping properties.

BACKGROUND OF THE INVENTION

Furniture tipping accidents and deaths are on the rise. The majority many of toddler furniture pieces, typically dressers, are anywhere from about 16 inches to about 24 inches deep and often toddlers can grab the top of the dresser, grab the top drawer of the dresser, and even climb into the bottom drawer of the dresser before the parent is aware of this. Top drawers of these dressers often have heavy contents in them further making the dresser easier to tip over, which when it occurs, often results in the toddler getting severely hurt, sometimes even rushed to the hospital and even more worrisome, a tragic death.

Many products on the market currently offer the ability to attach the upper back of a piece of furniture, e.g., a dresser, to the wall or other vertical support behind the dresser with a webbing strap or cable so the tipping issue is caught and restricted before the entire dresser falls forward. Yet, this can also allow the topmost dresser drawer to fall forward and still cause accidents. Proper fastening of the dresser to the wall poses yet another issue insofar as it is possible that the screws on the wall or the screws on the dresser are ripped apart when the tipping force is too much, especially if the webbing strap or cable is not attached properly in a safe or secure manner and location. After all, most dresser backs are very cheaply made with the backs often ⅛" thin pressboard or plywood and the frame is typically ⅝"-¾" and made of plywood or even less secure presswood typically used today.

Also, it is possible that the wall mounting was installed without the use of appropriate hardware such as mollies or lead plugs. If that were so, it would take little force for the tipping force exerted by the child or toddler to "rip" a wall-mounting bracket right off the wall thus allowing the dresser to continue its fall. Furthermore, if the frame is presswood, it would not take much force to "rip off" the mounting screws securing the webbing or cable to the frame or back.

The U.S. Consumer Product Safety Commission (CPSC) analyzed reported fatalities, reported nonfatal incidents and injuries, and calculated national estimates of injuries that were associated with furniture instability or tip overs. Each year, CPSC issues an annual report on furniture instability and tip overs. Incidents that involved the furniture tipping over, as well as incidents of instability with indications of impending tip over were considered. Tipover incidents are a subset of product instability incidents, and involve furniture actually falling over. Product instability incidents are a broader category that includes tipover incidents, but may also include incidents where furniture did not fully tip over. Instability incidents were considered relevant because product instability can lead to a tip over, and the same factors, such as product design, can contribute to instability and tip overs.

Over a multi-year reporting period, the CPSC identified 193 reported tipover fatalities to children (i.e., under 18 years old), 11 reported fatalities to adults (i.e., ages 18 through 64 years), and 22 reported fatalities to seniors (i.e., ages 65 years and older). Incidents that involved chests, bureaus, dressers, armoires, wardrobes, portable clothes lockers, and portable closets were considered. Of the 193 reported fatalities, there was one tip-over incident that resulted in two deaths, making the number of fatal incidents 192. Of the 193 reported tip-over child fatalities, 89 (46 percent) involved only a piece of furniture tipping over, whereas, 104 (54 percent) involved a piece of furniture and a television tipping over. Of the child fatalities, 190 (98 percent) involved a chest, bureau, or dresser, 2 involved a wardrobe, and 1 involved an armoire. Of the 33 reported adult and senior fatalities, 32 (97 percent) involved only a piece of furniture tipping over, whereas, 1 (9 percent) involved both a piece of furniture and a television tipping over. Of the adult and senior fatalities, 29 involved a chest, bureau, or dresser, 2 involved a wardrobe, 1 involved an armoire, and 1 involved a portable storage closet. For the years for which reporting is considered complete, 2000 through 2017, there have been from 3 to 21 child fatalities each year from tip overs, and up to 5 fatalities each year to adults and seniors.

Of the 193 reported child fatalities from tip overs, 166 involved children 3 years old or younger; 12 involved 4-year-olds; 7 involved 5-year-olds; 4 involved 6-year-olds; 1 involved a 7-year-old; and 3 involved 8-year-olds. Of the 89 reported child fatalities from tip overs involving only pieces of furniture (i.e., no televisions), 84 involved children 3 years old or younger; 2 involved 4-year-olds; 1 involved a 5-year-old; 1 involved a 6-year-old; and 1 involved a 7-year old. Thus, 94 percent of these fatalities were children 3 years old and younger; 97 percent were 4 years old and younger; 98 percent were 5 years old and younger; and 99 percent were 6 years old and younger. Therefore, regardless of television involvement, the most reported furniture tip-over fatalities happened to children 3 years old or younger. Among children 4 years and older, a television was more frequently involved than not involved.

Furniture tip-over fatalities to children were most commonly caused by torso injuries when only a piece of furniture was involved, and were more commonly caused by head injuries when both a piece of furniture and television tipped over. For the 89 child fatalities not involving a television, 58 resulted from torso injuries (chest compression); 13 resulted from head/torso injuries; 12 resulted from head injuries; 4 involved unknown injuries; and 2 involved a child's head, torso, and limbs pinned under the piece of furniture. For the 104 child fatalities that involved both a piece of furniture and television tipping over, 91 resulted from head injuries (blunt head trauma); 6 resulted from torso injuries (chest compression resulting from the child being pinned under the piece of furniture); 2 resulted from head/torso injuries; 4 involved unknown injuries; and 1 involved head/torso/limbs.

CPSC staff identified 1,002 reported nonfatal furniture tip-over incidents for all ages that were reported to have occurred between Jan. 1, 2005 and Dec. 31, 2020.

To assess the type of injuries that result from furniture tip overs, CPSC staff focused on incidents involving children, because the vast majority of tip-overs involve children. The types of injuries resulting from furniture tipping over onto children include soft tissue injuries, such as cuts and bruises (usually a sign of internal bleeding); skeletal injuries and bone fractures to arms, legs, and ribs; and potentially fatal injuries resulting from skull fractures, closed-head injuries, compressional and mechanical asphyxia, and internal organ crushing leading to hemorrhage. These types of injuries can result from tip overs involving pieces of furniture alone, or a piece of furniture with televisions.

As explained above, head injuries and torso injuries are common in tip-overs involving children. The severity of injuries depends on a variety of factors, but primary determinants include the force generated at the point of impact, the entrapment time, and the body part impacted. The head, neck, and chest are the most vulnerable. The severity of injury can also depend on the orientation of the child's body or body part when it is hit or trapped by the piece of furniture. Sustained application of a force that affects breathing can lead to compressional asphyxia and death. In most tip-over cases, serious injuries and death are a result of blunt force trauma to the head and intense pressure on the chest causing respiratory and circulatory system impairment.

Head injuries are produced by high-impact forces applied over a small area and can have serious clinical consequences, such as concussions and facial nerve damage. Such injuries are often fatal, even in cases where the child is immediately rescued and there is rapid intervention. An incident involving blunt head trauma can result in immediate death or loss of consciousness.

To identify hazard patterns associated with furniture tip overs, the CPSC focused on incidents involving children and furniture without televisions because the majority of fatal and nonfatal incidents involve children and, in recent years, there has been a statistically significant decrease in the overall number of tip-over incidents that appears to be driven by a decline in incidents involving furniture with televisions, while the rate of incidents involving furniture without televisions has remained stable.

Of the 89 fatal incidents involving children and only furniture, 53 (59 percent) provided information about whether the drawers contained items at the time of the tip over. Of those 53 incidents, 51 (96 percent) involved partially filled or full drawers. Of the 263 nonfatal tipovers involving children and only furniture, drawer fill level was reported for 67 incidents (25 percent). Of these 67 incidents, 60 (90 percent) involved partially filled or full drawers.

Of the 89 fatal tip overs involving children and only a piece of furniture, 47 reported the type of interaction the child had with the piece of furniture at the time of the incident. Of these 47 incidents, 35 (74 percent) involved a child climbing on the furniture; 8 (17 percent) involved a child sitting, laying, or standing in a drawer; and 4 (9 percent) involved a child opening drawers. Climbing was the most common reported interaction for children 3 years old and younger.

Thus, in fatal incidents, a child climbing on the piece of furniture was, by far, the most common reported interaction; and in nonfatal incidents, opening drawers and climbing were the most common reported interactions.

Climbing on the piece of furniture was one of the primary interactions involved in tip overs involving children and only a piece of furniture. It was the most common reported interaction (74 percent) in fatal incidents. The prevalence of children climbing during tip overs is consistent with the expected motor development of children. Between approximately 1 and 2 years old, children can climb on and off of furniture without assistance, use climbers, and begin to use playground apparatuses independently; and 2-year-olds commonly climb.

Opening the drawers of a piece of furniture was a common interaction in tipovers involving children and only a piece of furniture. Children as young as 11 months, and up to 14 years old were involved in incidents where the child was opening one or more drawers of the piece of furniture. Looking at both fatal and nonfatal tip overs involving children and only a piece of furniture, where the interaction involved opening drawers, overall, about 53 percent involved children opening one drawer, 10 percent involved opening two drawers, and almost 17 percent involved opening "multiple" drawers. In several incidents, children opened "all" of the drawers; it is possible that additional incidents, mentioning a specific number of open drawers (between 2 and 8), also involved all of the drawers being opened. In incidents where all of the drawers were open, the furniture ranged from 2-drawer to 8-drawer units. The youngest child reported to have opened all drawers was 13 months old.

It is possible for furniture to tip over from the forces generated by open drawers and their contents, alone, without additional interaction forces. However, pulling on a drawer to open it can apply increased force that contributes to instability. Once a drawer is fully opened, any additional pulling is on the furniture as a whole. The pull force, and the height of the drawer pull location, relative to the floor, are relevant considerations.

Of the 35 fatal climbing incidents, 13 reported the number of drawers open; in all of these incidents, the reported number of drawers open was one, although, based on further analysis, the number of open drawers could be as high as 8 in one incident.

Based on the incident data, children 3 years old and younger climb, open drawers without climbing, get items in and out of drawers, lean on open drawers, push down on open drawers, sit, or lay in bottom drawers, or stand on open bottom drawers. Among fatal tip-over incidents involving children and only a piece of furniture, climbing was the most common interaction for children 3 years old and younger; this drops off sharply for 4-year-olds. Starting at 4 years old, children do not appear to sit or lie in bottom drawers of a piece of furniture.

OBJECTS AND SUMMARY OF THE INVENTION

It is an object of at least one embodiment of the present invention to provide new and improved mechanisms for integrating or incorporating into pieces of furniture to prevent the furniture from tipping over.

It is yet another object of at least one embodiment of the present invention to provide a dresser that resists tipping when a bottom drawer of the dresser is open.

It is still another object of at least one embodiment of the present invention to provide a dresser that resists tipping when the toddler physically engages an open bottom drawer of the dresser or reaching the upper region of the dresser and pulling (tipping) it forward.

Another object of at least one embodiment of the present invention is to provide a dresser that resists tipping even when the toddler climbs on or into a bottom drawer region of the dresser.

A support hinge for a piece of furniture in accordance with the invention includes a mounting plate attached to an underside of a bottom drawer of the piece of furniture, by suitable attachment means or an integral or associated attachment mechanism, and a support plate hingedly connected to the mounting plate to enable the support plate to open rearward to an angle of greater than 90 degrees relative to the mounting plate. The support plate is biased into the open state and includes a drawer support portion configured to preferably contact the underside of the bottom drawer when the support plate is in the open state. A hinge mechanism may be used to hingedly connect the support plate and the mounting plate.

One exemplifying hinge mechanism is configured to enable the support plate to open to an angle of about 100 degrees relative to the mounting plate. When the mounting plate includes a hinge retaining portion at one side having cylindrical protrusions each with a channel therethrough, and the support plate includes a hinge retaining portion having cylindrical protrusions each with a channel therethrough, the hinge mechanism includes a cylinder that passes through the channels in the cylindrical protrusions in the hinge retaining portion of the mounting plate and the hinge retaining portion of the support plate. The drawer support portion extends to a position above (laterally beyond the upper edge) the cylindrical protrusions of the hinge retaining portion of the support plate. More generally, the hinge mechanism may include a cylinder partly retained by the mounting plate and support plate and at least one spring having a coiled part around the cylinder and a pair of legs, one exerting pressure against the mounting plate and the other exerting pressure against the support plate.

A piece of furniture with an integral anti-tipping mechanism in accordance with the invention includes a frame, a bottom drawer movable into and out of the frame, and a support hinge as described above. The bottom drawer may include a front panel and a front edge of the mounting plate is against a rear side of this front panel.

A method in accordance with the invention for preventing a piece of furniture having a frame and a bottom drawer movable into and out of the frame form tipping including attaching, when an underside of the bottom drawer is exposed, a support hinge as described above to the underside of the bottom drawer. The support plate is provided with a drawer support portion configured to contact the underside of the bottom drawer when the support plate is in the open state.

BRIEF DESCRIPTION OF THE DRAWINGS

The invention, together with further objects and advantages thereof, may best be understood by reference to the following description taken in conjunction with the accompanying drawings, wherein like reference numerals identify like elements, and wherein.

DETAILED DESCRIPTION OF THE INVENTION

One of the inventors' ideas to address the tipping problem of furniture in the presence of toddlers and children is that it is advantageous, instead of addressing attachment of a dresser or other piece of furniture to the wall against which it is placed, to address stability by attaching one or more supports under the bottom drawer to provide superior anti-tipping characteristics (for toddlers, parents, even TV stands).

In the embodiments disclosed herein, a dresser including a plurality of drawers in a vertical arrangement is often used as an example of a piece of furniture for which the anti-tipping mechanism may be used, and in which an anti-tipping mechanism may be integrated or incorporated. The anti-tipping mechanisms of the invention can be used on other types of furniture in addition to dressers and are not limited to use with only dressers. Also, the dressers may include one or more drawers in any of the sections therein.

Figure 1:
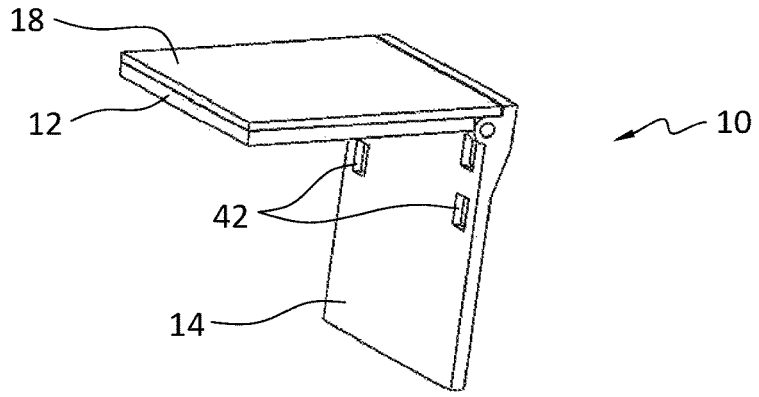
FIG. 1 is a perspective view of a support hinge in accordance with the invention.
Figure 2:
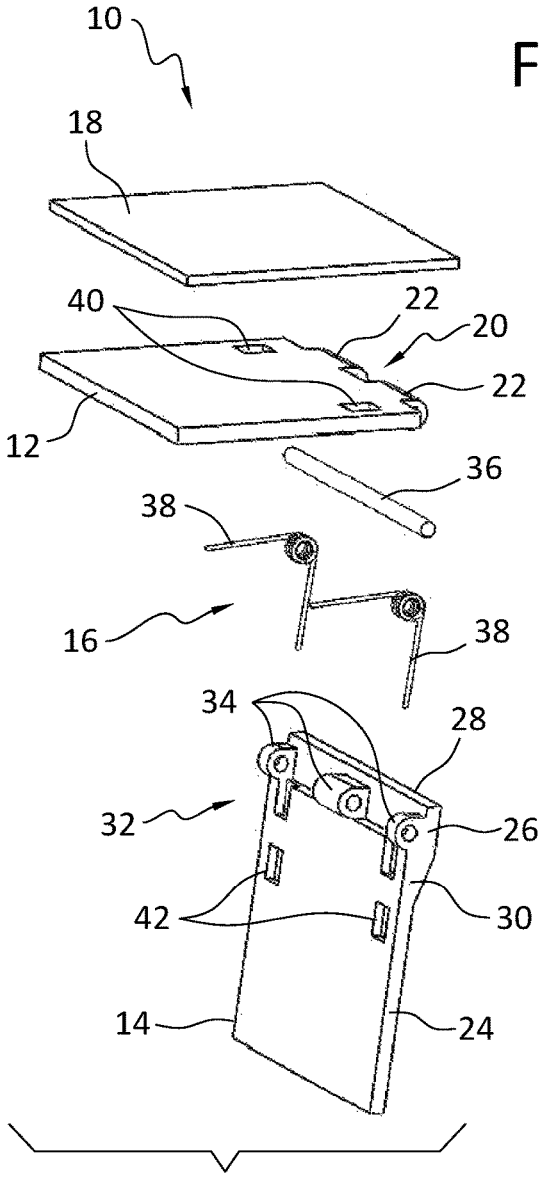
FIGS. 2 and 3 are exploded view of the support hinge shown in FIG. 1.
Figure 3:
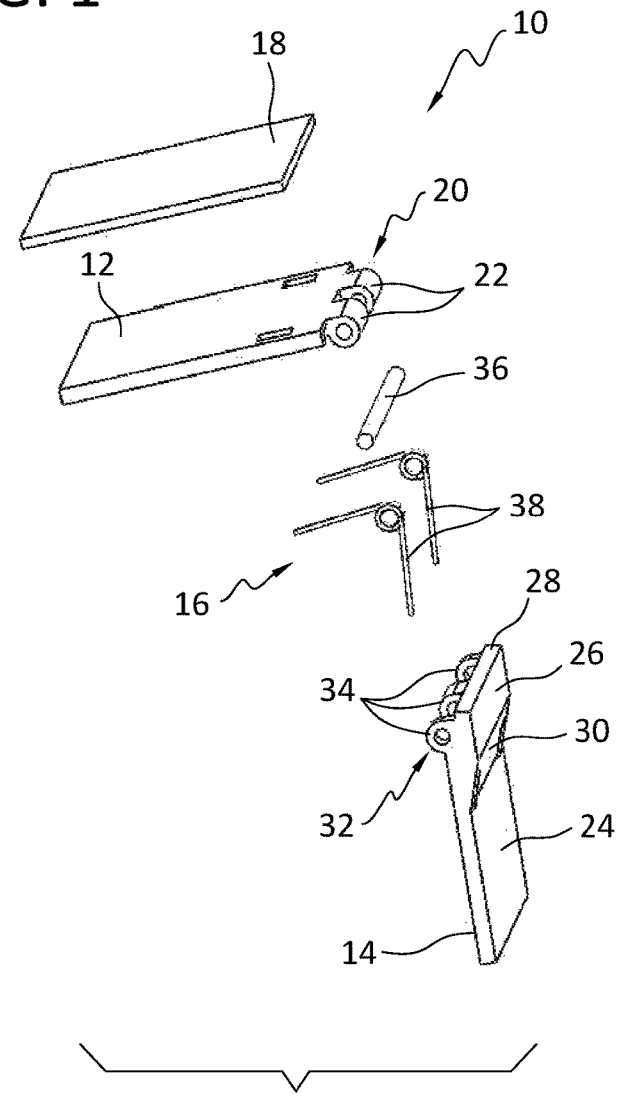

FIGS. 1-3 show a support hinge 10 in accordance with the invention that is, in use, attached to the underside of the support surface of the bottom drawer of a piece of furniture. Support hinge 10 includes a mounting plate 12, a support plate 14 connected to the mounting plate 12 by a hinge mechanism 16 and an attachment mechanism 18 to attach the mounting plate 12 to the underside of the support surface of the bottom drawer of the piece of furniture.

Mounting plate 12 includes planar upper and lower surfaces and has a generally rectangular shape. A hinge retaining portion 20 is provided at one side of the mounting plate 12 and includes two cylindrical protrusions 22 each with a channel therethrough.

Support plate 14 has a support portion 24 alongside a lower edge that includes planar upper and lower surfaces and has a generally rectangular shape. Support plate 14 also includes a drawer support portion 26 alongside an upper edge that provides a flat surface 28 that will, in use, come into contact with the underside of the bottom drawer of the piece of furniture. A transition region 30 between the support portion 24 and the drawer support portion 26 is angled with a variable thickness increasing in the direction of the drawer support portion 26 (see FIG. 3). Support plate 14 also includes a hinge retaining portion 32 alongside the drawer support portion 26 and which includes three cylindrical protrusions 34 each with a channel therethrough.

Cylindrical protrusions 22 and 34 are dimensioned relative to one another to allow them to mesh and provide an aligning channel.

An important aspect of the invention is that the drawer support portion 26 extends to a position above the cylindrical protrusions 34, i.e., to a position laterally beyond the upper edge so that the channels and cylindrical protrusions would be covered by the drawer support portion 26. As seen in FIG. 1, the flat surface 28 of the drawer support portion 26 will be approximately in alignment with or flush with the upper surface of the attachment mechanism 18. A contiguous surface or co-planar surfaces may be provided, but are not required.

The attachment mechanism 18 can be extra strong professional hook and loop fasteners such as VELCRO™, any type of permanent double-faced foam tape (3M is one example of a manufacturer), and even a nut and screw in which case the mounting plate 12 is provided with apertures. The extent to which the drawer support portion 26 is configured to distance the flat surface 28 from the cylindrical protrusions 34 determines to a large extent the degree to which the support plate 14 can pivot to its open state relative to the mounting plate 12. This opening should be greater than 90 degrees and more likely about 100 to about 110 degrees. This degree of opening will present the support hinge 10 from closing if a child should be in the bottom drawer, and will also provide a sufficient support for the bottom drawer to prevent the furniture from tipping over.

When the term "about" is used with reference to an angular opening, it is meant that the angular opening may be within a range of up to 2 degrees plus or minus this value, or within a range of up to 3 degrees plus or minus this value or within a range of up to 4 degrees plus or minus this value. One skilled in the art would be able to determine how to interpret about 100 or about 110 degrees in view of the disclosure herein and the stated objective to prevent the support plate 14 from being forced into a closed position when weight is applied to an open bottom drawer 54A and instead provide a post support to limit forward tipping of a piece of furniture 50 (see FIGS. 4-9 below).

Conventional hinges are not believed to include this extension region which is formed from the drawer support portion 26 of the support plate 14. Support plate 14 therefore has this additional thickened region alongside the cylindrical protrusions 34. The transition region 30 serves as a reinforcement to strengthen the support plate 12 and enable any weight applied to the flat surface 28 by pressure exerted on the bottom drawer to be adequately dissipated.

Hinge mechanism 16 includes a cylinder 36 that passes through the channels of the cylindrical protrusions 22, 34 (see FIGS. 2 and 3). It is inserted therethrough from one end to the other end. Hinge mechanism 16 also includes springs 38 that each have a coiled part and legs with the coiled part being dimensioned to fit around the cylinder 36. The springs 38 should be positioned between the cylindrical protrusions 22, 34 and thus sandwiched between the mounting plate 12 and the support plate 14. Instead of springs 38, other biasing mechanisms may be used, e.g., one spring or multiple springs.

Springs 38 may be preferably double torsion springs, configured to provide a desired force so as to keep the hinge 10 fully opened, to about 100 degrees, and resist a toddler from closing it. The force of closing the drawer by a parent will sufficiently engage and close the hinge mechanism 18 with sufficient force not capable by a toddler, or even a 5 year old child.

The ends of the legs of the springs 38 are configured to extend into cavities 40 in the mounting plate 12 and cavities 42 in the support plate 14 (see FIG. 2).

The attachment mechanism 18 may be any device or mechanism that can operatively attach the upper side of the mounting pate 12 to the underside of the bottom drawer of the piece of furniture. As shown, the attachment mechanism 18 has a rectangular form and represents hook and loop fasteners or double-sided tape. Alternatively, the mounting plate 12 can be provided with apertures and screws or nails used to attach the mounting plate 12 to the drawer. All such materials that can attach the mounting plate 12 to the bottom drawer are encompassed within the term attachment means as used herein. In a preferred embodiment, the attachment means may be professional grade hook and loop fasteners (like VELCRO™) or professional grade permanent 3M double faced tape. Nails are not preferred. The attachment means may be configured to provide a permanent or temporary attachment, but it must be a secure attachment.

FIGS. 4-9 shows the manner in which the support hinge 10 is attached to a piece of furniture 50. The piece of furniture 50 includes a frame 52 with a rear wall, side walls, a top wall and a front wall in which apertures are formed, and drawers 54 that move through the apertures into and at partly out of the frame 52. As mentioned above, the piece of furniture 50 does not in any way limit the invention and the support hinge 10 can be used with any piece of furniture with a bottom drawer. The support structure for the drawers 54 and other components of the piece of furniture 50 are not shown, and not essential for an understanding of the invention.

The support hinge 10 is attached to the underside of the bottom support panel 56 (see FIGS. 4 and 5) of the lowermost drawer 54A with the hinge mechanism 18 at the rear, i.e., more proximate the rear of the frame 52 than the front of the frame 52 so that the supporting hinge 10 is biased to open rearward. More specifically, the attachment mechanism 18 is used to attach the mounting plate 12 to the bottom support panel 56. To this end, if the attachment mechanism 18 is double-sided adhesive or hook and loop fasteners like VELCRO™, then the covering sheet on the double-sided adhesive would be peeled off to expose the adhesive and this would be pressed against the underside of the bottom support panel 56 of the lowermost 54A when the lowermost drawer 54A is either in an open position or possibly removed from the piece of furniture 50. This removal is often possible, depending on the construction of the slide mechanism that enables the drawer 54A to slide into and out of the frame 52.

Positioning of the support hinge 10 is important because it must be close to or preferably against the front panel 58 of the drawer 54A. As shown, the support hinge 10 is against the front panel 58, i.e., the front edge of the mounting plate 12 is in contact with the rear surface of the front panel 58 of the drawer 54A (see FIGS. 4-7).

Figure 4:
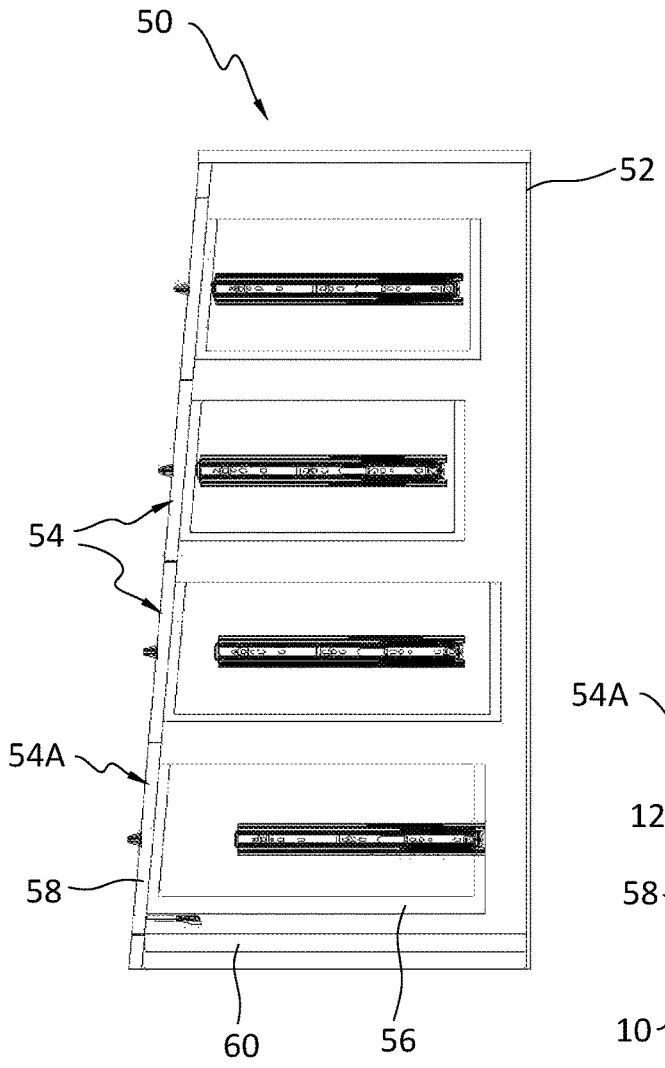
FIG. 4 is a cross-sectional view of a piece of furniture showing the support hinge of FIG. 1 in place.

When the drawer 54A is inside of the frame 52, the support plate 14, even though biased to an open state, is in a position close to the mounting plate 12 as a result of pressure exerted by a bottom panel 60 in the frame 52 (see FIG. 4). This bottom panel 60 should provide a surface along which the support plate 14 can slide as the drawer 54A moves. The support plate 14 of the supporting hinge 10 thereby rests on a structural member of the piece of furniture 50 and never is trapped so as to prevent the drawer 54A from opening or closing. Functionality and use of the support hinge 10 depends on the support hinge 10 not being trapped inside the frame 52 of the piece of furniture 50.

Figure 5:
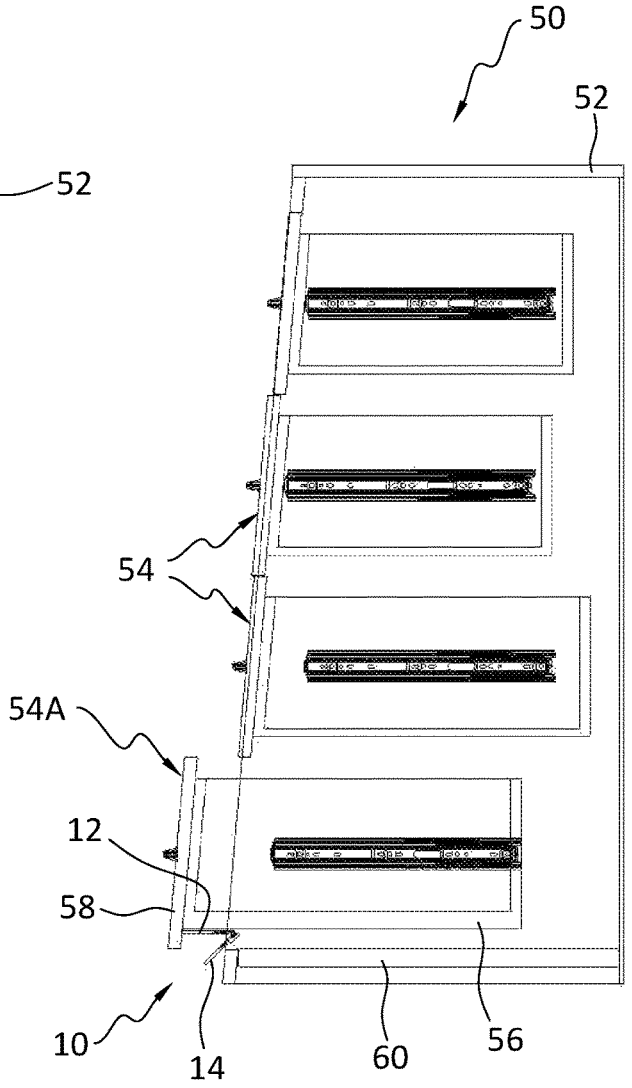
FIG. 5 is a cross-sectional view of the piece of furniture showing the state of the support hinge of FIG. 1 as the bottom drawer of the piece of furniture is opened.
Figure 6:
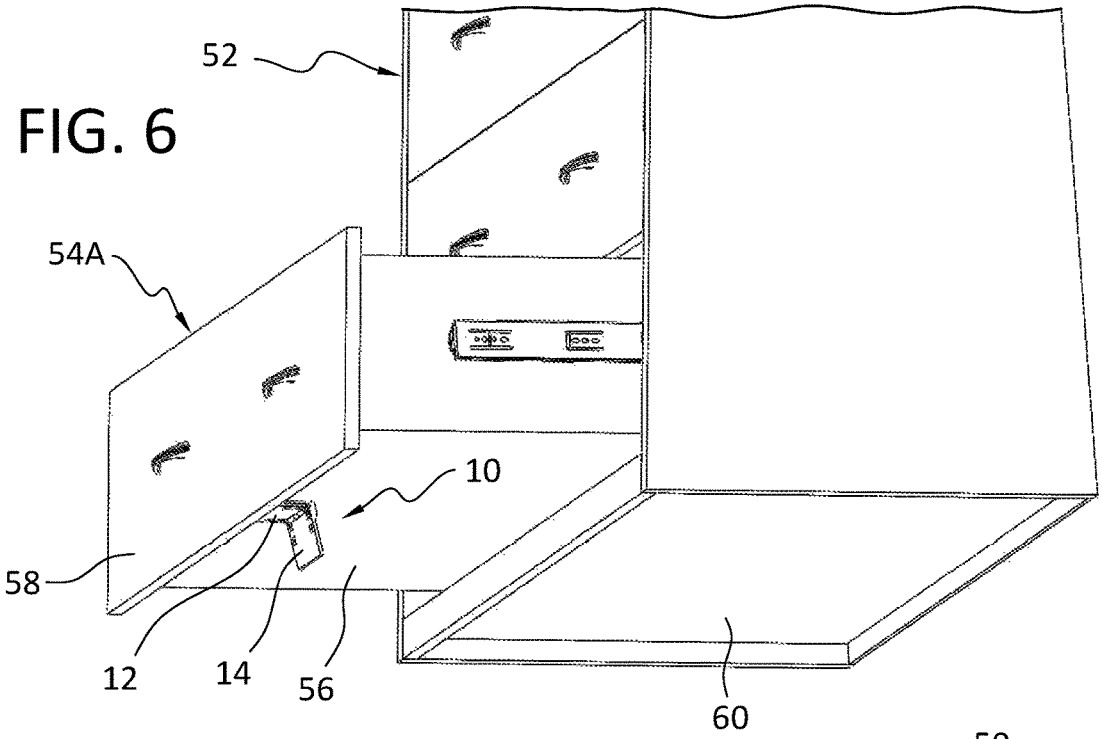
FIG. 6 is a perspective view of the piece of furniture showing the state of the support hinge of FIG. 1 in its fully open state.

As the person begins to slide the drawer 54A out of the frame 52, see FIG. 5, the springs 38 cause the support plate 14 to move in a direction away from the mounting plate 12, i.e., open in a rearward direction. Continued outward movement of the drawer 54A results in the support plate 14 being moved to a fully open position as shown in FIG. 6, i.e., it is pivoted about the hinge mechanism 18 into its open state. This fully open position is determined by the properties of the support hinge 10, such as the construction of the springs 38 or other biasing mechanism and the components thereof. In the fully open position, the support plate 14 of the support hinge 10 can function like a post, i.e., as an additional support point for the piece of furniture 50.

Figure 8:
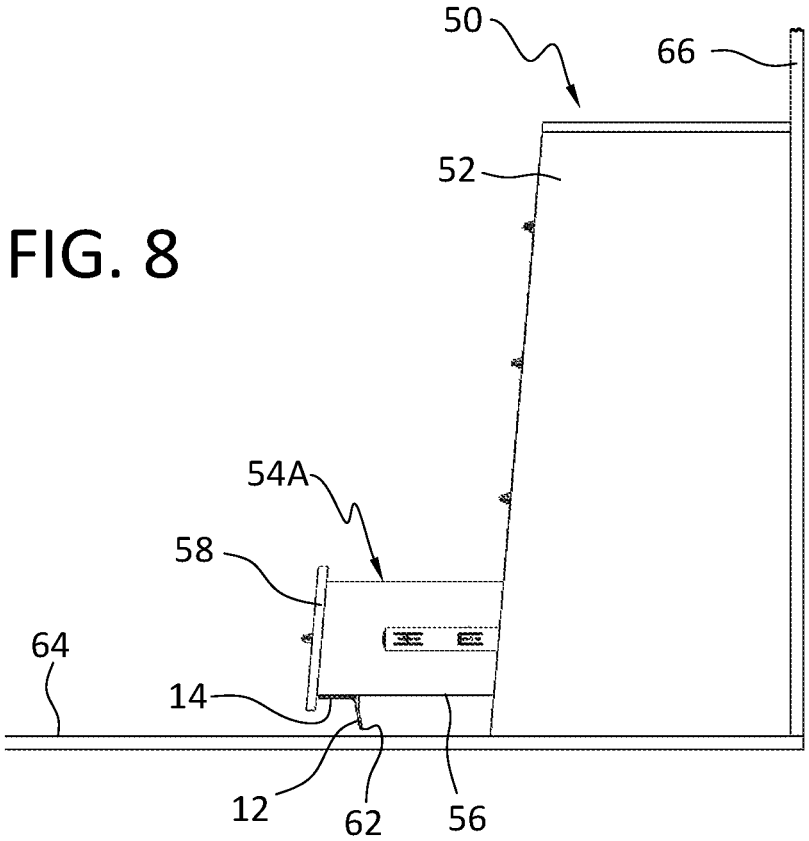
FIG. 8 is a side view showing the piece of furniture with the bottom drawer open.

In this position, the support plate 14 is not in contact with the floor or horizontal substrate 64 under the piece of furniture 50. Rather, as shown in FIG. 8, there is an intentionally a gap 62 of about 0.5 inches between the bottom of the support plate 14 and the horizontal surface 64 under the piece of furniture 50. This gap 62 is ensured by appropriate construction of the support hinge 10 relative to the piece of furniture 50. To this end, various sizes of support hinges 10 may be made and instructions provide to purchase a specific size based on the dimensions of the piece of furniture 50.

Since there are numerous different types and shapes of furniture, whether dressers or other types of furniture, the invention contemplates several different sizes of support hinges 10, with different sizes of support plates 14 and/or drawer support portions 26, so as to allow the support plates 14 to extend to a position above or laterally beyond the horizontal surface 64 on which the piece of furniture is situated preferably by about 0.5 inches while the drawer support portion 26 is able to contact or otherwise be engaged by the underside of the bottom drawer 54A. With a 0.5 inch gap 62 between the lower edge of the support plate 14 and the floor 64 (see FIG. 8), the piece of furniture 50 will be able to tip forward no more than a few degrees (see FIG. 9) and not exceed that so as to cause full tipping, etc.

It is thus important that the support plate 14 does not engage the floor 64 when opening and closing. The identified dimension of a 0.5 inch gap 62 has been found to be conducive to achieve this purpose but is not exclusive and other sizes of the gap 62 may be used, provided the objectives of the invention disclosed herein are achieved. The size of the gap 62 may also depend on the type of floor 64 on which the piece of furniture 50 is placed. Thus, a 0.5 inch gap 62 would be adequate for a floor 64 with a smooth surface but for a carpeted floor, the gap 62 should be slightly larger.

The angular opening of the support hinge 10 is preferably more than 90 degrees, and could be in the range of about 100 to about 110 degrees (but these parameters and this range are not limiting). Regardless of the angular opening, the support plate 14 is at an angle of greater than 90 degrees to the mounting plate 12 so that if a toddler 8 is in the bottom drawer 54A, the piece of furniture 50 may tilt forward a very limited amount but rather tipping and definitely tipping over is prevented because the support plate 14 makes contact with the horizontal surface 64 below the piece of furniture 50 and provides and additional support point (see FIGS. 7 and 9).

Figure 9:
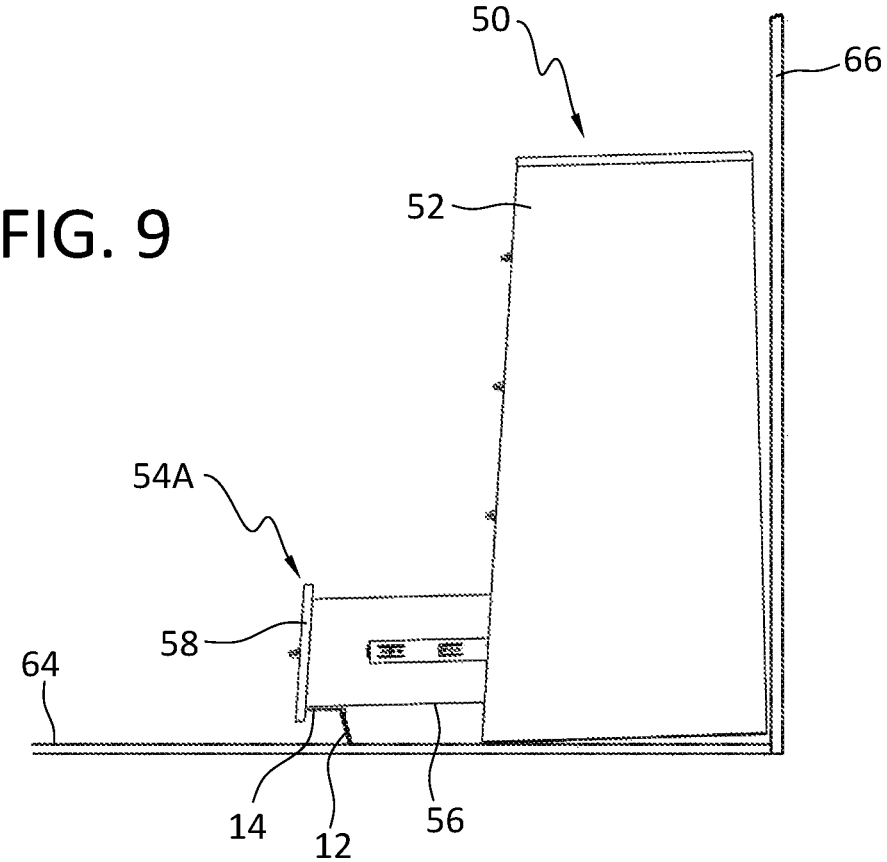
FIG. 9 is a side view showing the piece of furniture tipped slightly forward as a result of, for example, a child having climbed into the bottom drawer, but further tipping being prevented.

FIG. 9 shows that the piece of furniture 50 can tip no more than a few degrees should a toddler press down or climb into the bottom drawer 54A. Initially, the piece of furniture 50 would have its rear surface against or flush with the back wall 66 behind the piece of furniture 50 and when the bottom drawer 54A is open, the lower edge of the support plate 54 is pivoted outward and about 0.5 inches from the floor 64, Then, the pressure exerted by the toddler, if present in the bottom drawer 54A or pulling down one of the other drawers 54, causes the slight forward tilt of the piece of furniture 50 pulling it away from the back wall 66. Such forward tilting is, as mentioned above, prevented once the lower edge of the support plate 14 comes into contact with the floor 64 as shown in FIG. 9. Thus, should the toddler 8 climb into the bottom drawer 54 or possibly even another drawer 54 above the bottom drawer 54A, the, for example, about 100 degree opening of the support hinge will increase a few degrees and add to the prevention of the support hinge 10 from collapsing.

The support hinge 10 thus creates a positive stop preventing it from opening anymore and no less than the designated preferably about 100 degrees. Complete tipping over of the piece of furniture 50 is thereby prevented, reducing, and possibly eliminating injury to the toddler 8. Thus, although there will be some tipping of the piece of furniture 50, this tilting is severely limited and stopped as soon as the support plate 14 comes into contact with the floor. The piece of furniture therefore cannot tilt more than 0.5 inches, or whatever the distance is between the bottom of the support plate 14 and the underlying floor.

Moreover, as a result of this angular orientation of the support plate 14 relative to the mounting plate 12, the support plate 14 cannot be urged to fold if the toddler 8 should push the drawer 54A downward and in the direction into the piece of furniture 50. Once the support plate 14 makes contact with the floor and is in the greater than 90 degree state, it is difficult to close it.

Closure of the drawer 54A is attained when the person pushes the drawer 54A into the piece of furniture 50, provided the drawer 54A is not weighted down with the support plate 14 in contact with the floor. In this case, the person would have to slightly lift the drawer 54A upward and then push it back into the piece of furniture 50.

Support hinge 10 may be added onto the piece of furniture 50 after purchase, being sold separately, or incorporated into new furniture.

Figure 7:
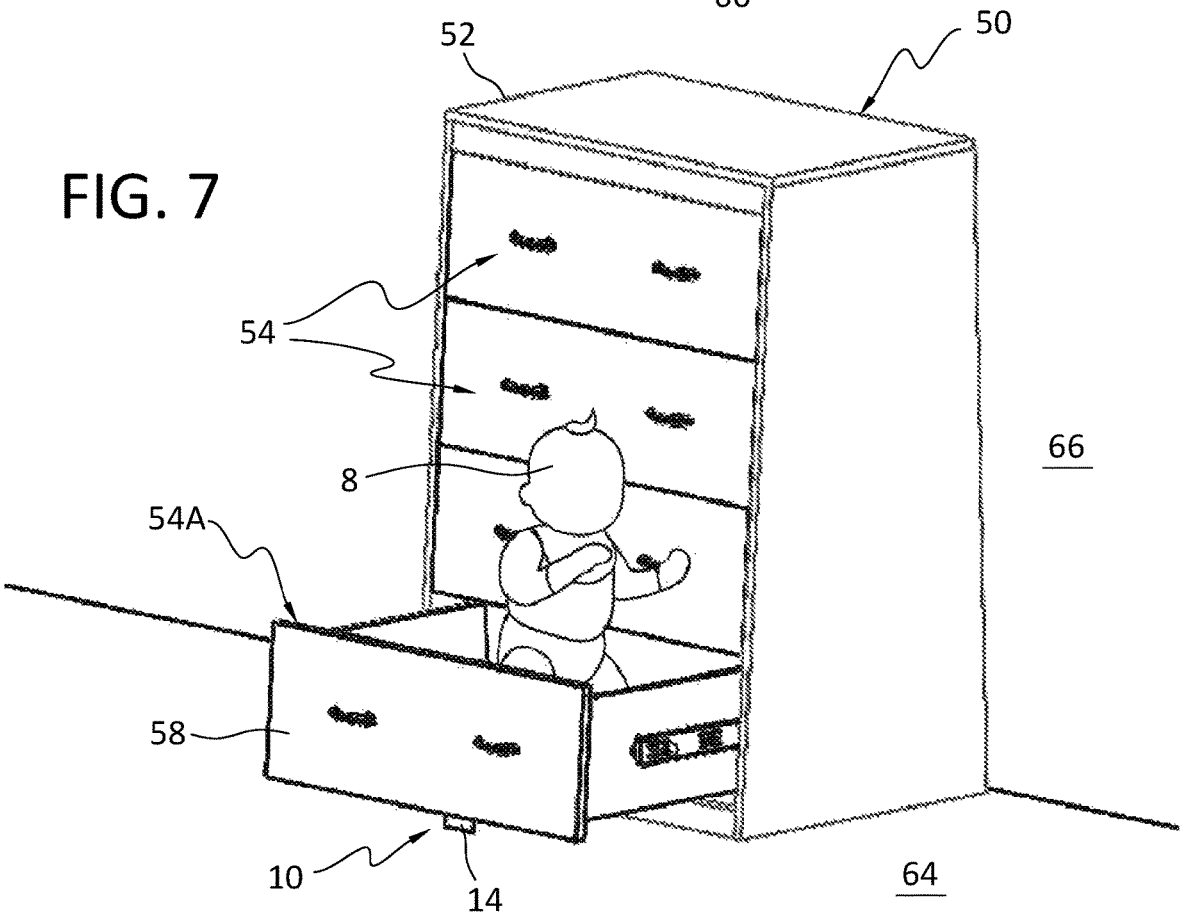
FIG. 7 is a perspective view of the piece of furniture showing a toddler in the open bottom drawer of the piece of furniture and the support hinge in use preventing tipping over of the piece of furniture.

As shown FIGS. 6 and 7, there is a single support hinge 10 on the bottom drawer 54A. For wider drawers, there may be two or more support hinges 10 positioned to stabilize the drawer 54A when a toddler is in the drawer 54A or otherwise pulling the piece of furniture 50 downward at the start of a tipping over scenario. Two or more support hinges 10 also prevent the drawer 54 from being cocked to one side or the other should a toddler 8 climb in. The benefit of having two support hinges 10 further ensures the piece of furniture 50 from collapsing the support hinge 10 when a toddler attempts to climb in from the side instead of the front.

The support hinges 10 may be optionally removed once the toddler 8 has sufficiently grown up, and the likelihood of them climbing into the bottom drawer 54A is minimal. However, it is not envisioned that the presence of the support hinge 10 will drastically or even nominally affect the use of the piece of furniture 10 and it can be maintained without impact to the use of the piece of furniture 50.

In an optional embodiment of the support hinge 10, a mechanical lock may be provided to lock the support plate in the extended position, and prevent it from collapsing unintentionally. This lock may be a spring-engaged lock.

While these embodiments are directed to the serious, often fatal, accidents involving toddlers, they address all anti-tipping furniture issues that may arise, involving both toddlers and adults.

While particular embodiments of the invention have been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

The invention claimed is:

1. A support hinge for a piece of furniture, comprising:

a mounting plate including a hinge retaining portion at one side having cylindrical protrusions each with a channel therethrough;

attachment means for attaching said mounting plate to an underside of a bottom drawer of the piece of furniture;

a support plate hingedly connected to said mounting plate to enable said support plate to open rearward to an angle of greater than 90 degrees relative to said mounting plate and being biased into an open state, said support plate including:

a drawer support portion configured to contact the underside of the bottom drawer when said support plate is in the open state, and a hinge retaining portion having cylindrical protrusions each with a channel therethrough, said drawer support portion extending to a position laterally beyond said cylindrical protrusions of said hinge retaining portion of said support plate; and a hinge mechanism that hingedly connects said support plate and said mounting plate, said hinge mechanism including a cylinder that passes through said channels in said cylindrical protrusions in said hinge retaining portion of said mounting plate and said hinge retaining portion of said support plate.

2. The support hinge of claim 1, wherein said hinge mechanism is configured to enable said support plate to open to an angle of about 100 degrees relative to said mounting plate.

3. The support hinge of claim 1, wherein said cylinder is partly retained by each of said mounting plate and said support plate and said hinge mechanism further comprises at least one spring having a coiled part around said cylinder and a pair of legs, one of said legs exerting pressure against said mounting plate and the other of said legs exerting pressure against said support plate.

4. The support hinge of claim 3, wherein said at least one spring comprises two springs spaced apart from one another.

5. The support hinge of claim 1, wherein said attachment means comprise an adhesive layer, said drawer support portion extending to align with an upper surface of said adhesive layer.

6. A piece of furniture with an integral anti-tipping mechanism, comprising:

a frame, said bottom drawer being movable into and out of said frame; and the support hinge of claim 1, said mounting plate being attached to the underside of said bottom drawer in a position in which the support hinge is inside said frame when said bottom drawer is in a closed state.

7. The piece of furniture of claim 6, wherein said bottom drawer includes a front panel and a front edge of said mounting plate is against a rear side of said front panel.

8. A support hinge for a piece of furniture, comprising:

a mounting plate;

attachment means for attaching said mounting plate to an underside of a bottom drawer of the piece of furniture;

a support plate hingedly connected to said mounting plate to enable said support plate to open rearward to an angle of greater than 90 degrees relative to said mounting plate and being biased into an open state, said support plate including a drawer support portion configured to contact the underside of the bottom drawer when said support plate is in the open state; and a hinge mechanism that hingedly connects said support plate and said mounting plate, said hinge mechanism comprising a cylinder partly retained by each of said mounting plate and said support plate and at least one spring having a coiled part around said cylinder and a pair of legs, one of said legs exerting pressure against said mounting plate and the other of said legs exerting pressure against said support plate.

9. The support hinge of claim 8, wherein said hinge mechanism is configured to enable said support plate to open to an angle of about 100 degrees relative to said mounting plate.

10. The support hinge of claim 8, wherein said mounting plate includes a hinge retaining portion at one side having cylindrical protrusions each with a channel therethrough, and said support plate includes a hinge retaining portion having cylindrical protrusions each with a channel therethrough, said cylinder passing through said channels in said cylindrical protrusions in said hinge retaining portion of said mounting plate and said hinge retaining portion of said support plate.

11. The support hinge of claim 8, wherein said at least one spring comprises two springs spaced apart from one another.

12. The support hinge of claim 8, wherein said attachment means comprise an adhesive layer, said drawer support portion extending to align with an upper surface of said adhesive layer.

13. A piece of furniture with an integral anti-tipping mechanism, comprising:

a frame, said bottom drawer being movable into and out of said frame; and the support hinge of claim 8, said mounting plate being attached to the underside of said bottom drawer in a position in which the support hinge is inside said frame when said bottom drawer is in a closed state.

14. The piece of furniture of claim 13, wherein said bottom drawer includes a front panel and a front edge of said mounting plate is against a rear side of said front panel.

15. A support hinge for a piece of furniture, comprising:

a mounting plate;

attachment means for attaching said mounting plate to an underside of a bottom drawer of the piece of furniture, said attachment means comprising an adhesive layer;

a support plate hingedly connected to said mounting plate to enable said support plate to open rearward to an angle of greater than 90 degrees relative to said mounting plate and being biased into an open state, said support plate including a drawer support portion configured to contact the underside of the bottom drawer when said support plate is in the open state, said drawer support portion extending to align with an upper surface of said adhesive layer.

16. The support hinge of claim 15, further comprising a hinge mechanism that hingedly connects said support plate and said mounting plate.

17. The support hinge of claim 16, wherein said hinge mechanism is configured to enable said support plate to open to an angle of about 100 degrees relative to said mounting plate.

18. The support hinge of claim 16, wherein said mounting plate includes a hinge retaining portion at one side having cylindrical protrusions each with a channel therethrough, and said support plate includes a hinge retaining portion having cylindrical protrusions each with a channel therethrough, said hinge mechanism including a cylinder that passes through said channels in said cylindrical protrusions in said hinge retaining portion of said mounting plate and said hinge retaining portion of said support plate.

19. The support hinge of claim 16, wherein said hinge mechanism comprise a cylinder partly retained by each of said mounting plate and said support plate and at least one spring having a coiled part around said cylinder and a pair of legs, one of said legs exerting pressure against said mounting plate and the other of said legs exerting pressure against said support plate, said at least one spring comprising two springs spaced apart from one another.

20. A piece of furniture with an integral anti-tipping mechanism, comprising:

a frame, said bottom drawer being movable into and out of said frame; and the support hinge of claim 15, said mounting plate being attached to the underside of said bottom drawer in a position in which the support hinge is inside said frame when said bottom drawer is in a closed state.

* * * * *